United States Patent [19]

de Vries

[11] 4,378,881

[45] Apr. 5, 1983

[54] PORTABLE SECURING ASSEMBLY FOR AN ELECTRIC MUSICAL INSTRUMENT

[76] Inventor: Paul de Vries, 38 W. 10th St., New York, N.Y. 10011

[21] Appl. No.: 320,197

[22] Filed: Nov. 12, 1981

Related U.S. Application Data

[63] Continuation of Ser. No. 95,437, Nov. 19, 1979, abandoned.

[51] Int. Cl.[3] ..... A45C 11/00

[52] U.S. Cl. ..... 206/314; 84/174; 84/176; 84/177; 84/180

[58] Field of Search ..... 206/314; 84/171–183

[56] References Cited

U.S. PATENT DOCUMENTS

| | | | |
|---|---|---|---|
| 2,837,004 | 6/1958 | Volpe | 84/174 |
| 3,100,415 | 8/1963 | Anderson | 84/177 |
| 3,146,658 | 9/1964 | Mandy et al. | 84/177 |
| 3,230,814 | 1/1966 | Welts | 84/180 |
| 3,478,159 | 11/1969 | Olson | 84/176 |
| 3,750,516 | 8/1973 | Olson | 84/174 |

FOREIGN PATENT DOCUMENTS

| | | | |
|---|---|---|---|
| 525347 | 3/1955 | Italy | 84/174 |
| 631573 | 1/1962 | Italy | 84/176 |

*Primary Examiner*—Joseph Man-Fu Moy

*Attorney, Agent, or Firm*—Curtis, Morris & Safford

[57] ABSTRACT

A portable electric keyboard musical instrument is disclosed which includes (1) a two-part folding supporting structure, (2) a plurality of vibratile reeds with each having an end fixedly attached to the supporting structure, (3) a plurality of actions for selectively causing respective reeds to vibrate and pickup devices used in spaced relation to the reeds for generating an electrical frequency from the vibrations of the reeds. The keyboard is contained in a hand transportable case which is foldable and serves as a support and protective assembly for the keyboard.

7 Claims, 6 Drawing Figures

2
4
6
6
6
12
46
48
86
86
10
12
14
16
18
20
24
24
26
28
30
32
34
36
38
40
42
44
50
52
56
58
60
62
80
82
84

PORTABLE SECURING ASSEMBLY FOR AN ELECTRIC MUSICAL INSTRUMENT

This is a continuation of application Ser. No. 095,437 filed Nov. 19, 1979 now abandoned.

This invention relates generally to electric keyboard musical instrument and, more particularly, it is directed to an improved foldable electric keyboard musical instrument assembly of the type which is hand-transportable.

BACKGROUND OF THE INVENTION

As far as it is known, prior efforts to make portable keyboard musical instruments of the struck-reed type have resulted in instruments which are not easily carried about. Such prior instruments weigh at least 70 pounds and have a minimum rigid length for four octaves of at least 30 inches. As such they are not truly hand transportable keyboard musical instruments which can readily be carried about by travelers, students and the like.

OBJECTS AND SUMMARY OF THE INVENTION

Accordingly, it is an object of the present invention to provide an electric keyboard musical instrument which is of relatively simple construction, and which is foldable, portable and lightweight.

More particularly, it is an object of the invention to provide an electric keyboard musical instrument of the struck-reed type which utilizes a plurality of reeds as the musical tone generators and is contained in an assembly that is both a folding case and a support for the actions, and includes protective panels which are readily and securely positioned to protect the keyboard and just as readily removed to permit it to be used.

Another object is to provide an assembly which is compact and functional and permits the protective keyboard panels to be utilized as a music stand supported on the housing of the assembly.

The present invention is particularly adapted to be used with a keyboard which provides a range of at least four octaves and includes an action similar to the Viennese-type action. The keyboard and action is more fully described in my copending application entitled "Electric Keyboard Musical Instrument" which is filed concurrently with this case, Ser. No. 95,558, Nov. 19, 1979, now U.S. Pat. No. 4,314,494, issued Feb. 9, 1982.

The keyboard is advantageously foldable and is contained within assembly halves which serve as a protective case and as a support means. Further, the assembly arrangement permits the advantageous location of a power supply, amplifiers, volume controls, and speakers. In addition, the compact construction of the assembly permits input-output connections to be located within the housing of the assembly without interference with the keyboard. The assembly halves form a housing, including two box-like members hingably connected so that the keyboard may be folded so that the base of the instrument is folded upon itself. Yet, the keys and actions are protected because of secured but removeable panel members which cover the keys.

DETAILED DESCRIPTION OF THE PREFERRED EMBODIMENT

Figure 1:
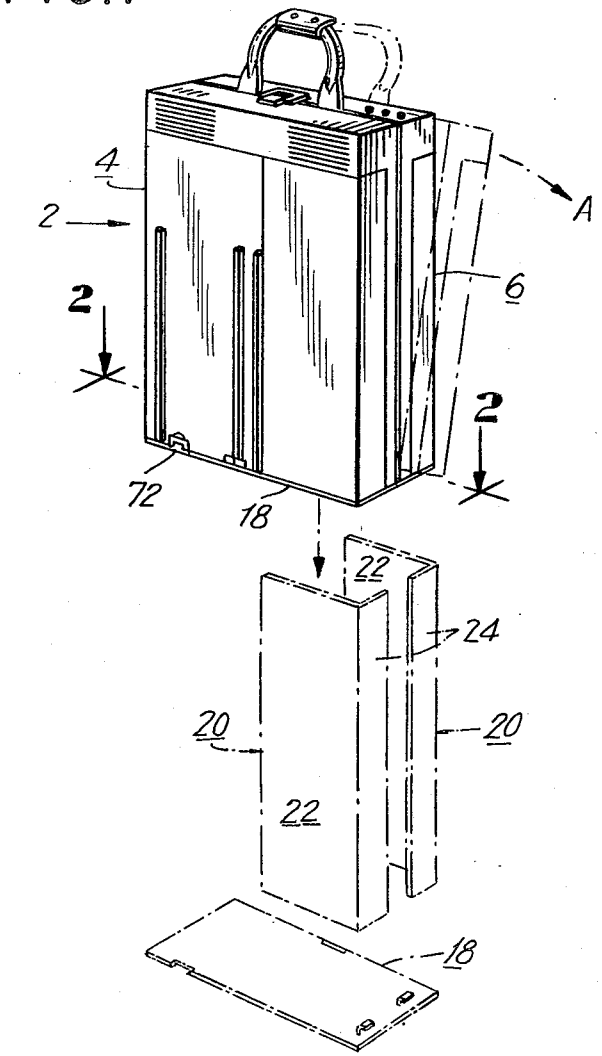
FIG. 1 is a perspective view of an electric keyboard musical instrument according to the present invention showing the instrument in a carrying case mode with the removeable panels shown in phantom lines.

Referring to the drawings and to FIG. 1 in particular, a keyboard instrument 2 in accordance with the present invention is shown in the closed or folded configuration whereby the folded unit gives the overall appearance of a carrying case. The illustrated instrument weighs approximately 20 pounds and has a length of about 16 inches in the folded configuration and it may be easily transported by hand from one place to another. Advantageously, by having the instrument adapted to be compactly folded into a carrying condition, the cost of the instrument is reduced by combining together its support means and the protective case.

Figure 2:
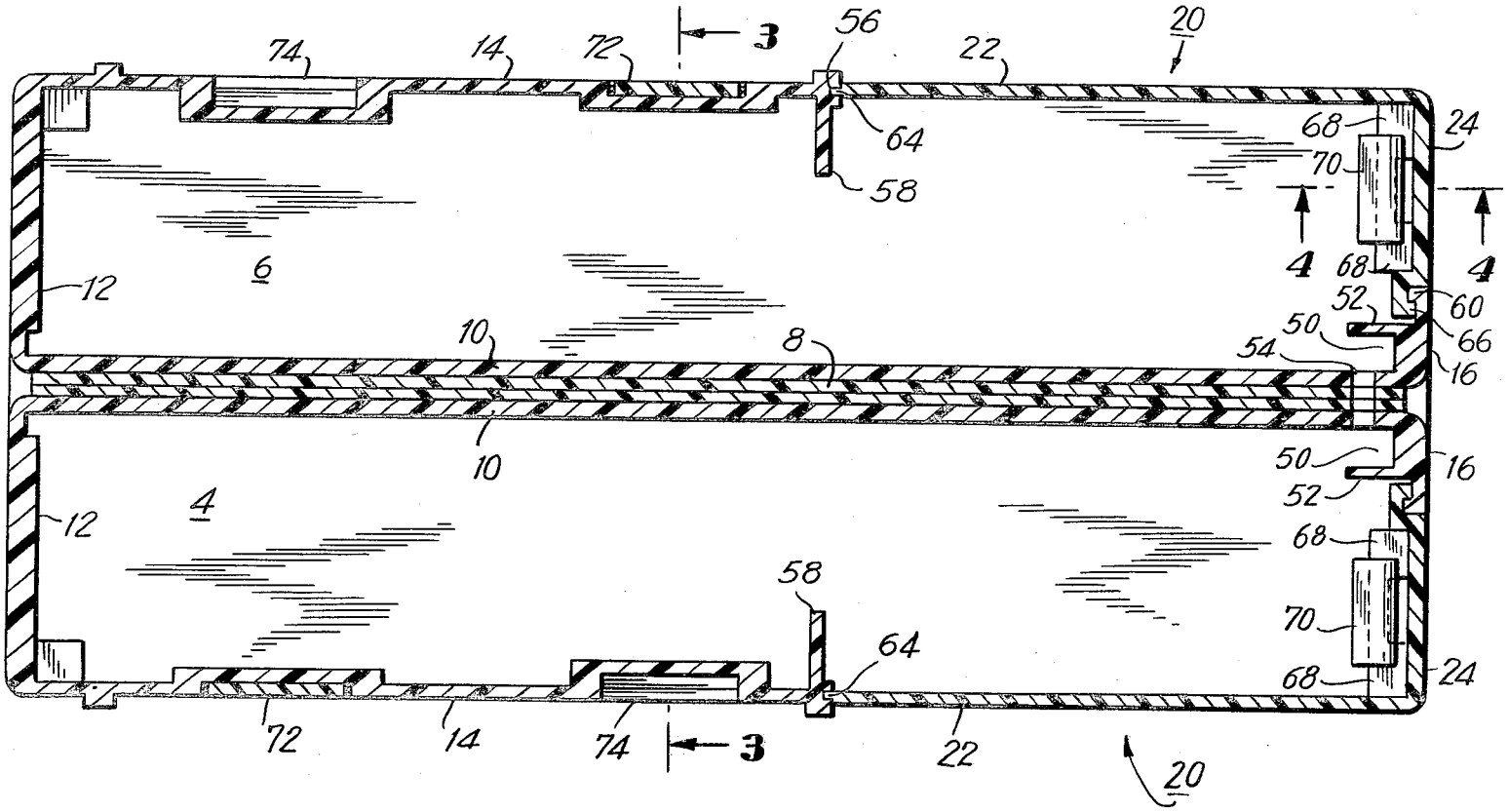
FIG. 2 is a cross-sectional view of the housing assembly of the instrument of FIG. 1, taken along lines 2—2.

The instrument 2 is comprised of two assembly halves 4 and 6 which are box-like housings and connected together by a hinge 8. As shown in FIG. 2 in particular, the hinge 8 connects the two assembly halves together along one edge of their base members 10. Each base member 10 is connected to longitudinal wall 12 and the longitudinal wall 12 to a top wall 14. Opposite the longitudinal wall 12 and extending upwardly from the base member 10 is a longitudinal flange 16. The longitudinal wall 12 and the top wall 14 are advantageously separable in order to provide access to the components of the instrument. To complete the top bottom and longitudinal surfaces of the assembly halves, the top wall 14 and the longitudinal flange are connected by means of side panel 20 which is shaped as an angle member and has a top portion 22 and a front portion 24.

When the side panels 20 are in place, they are connected to a single end panel 18 which cooperates with the remainder of the assemblies to form the base for the instrument when it is in its folded and carry case configuration.

Figures 5, 6:
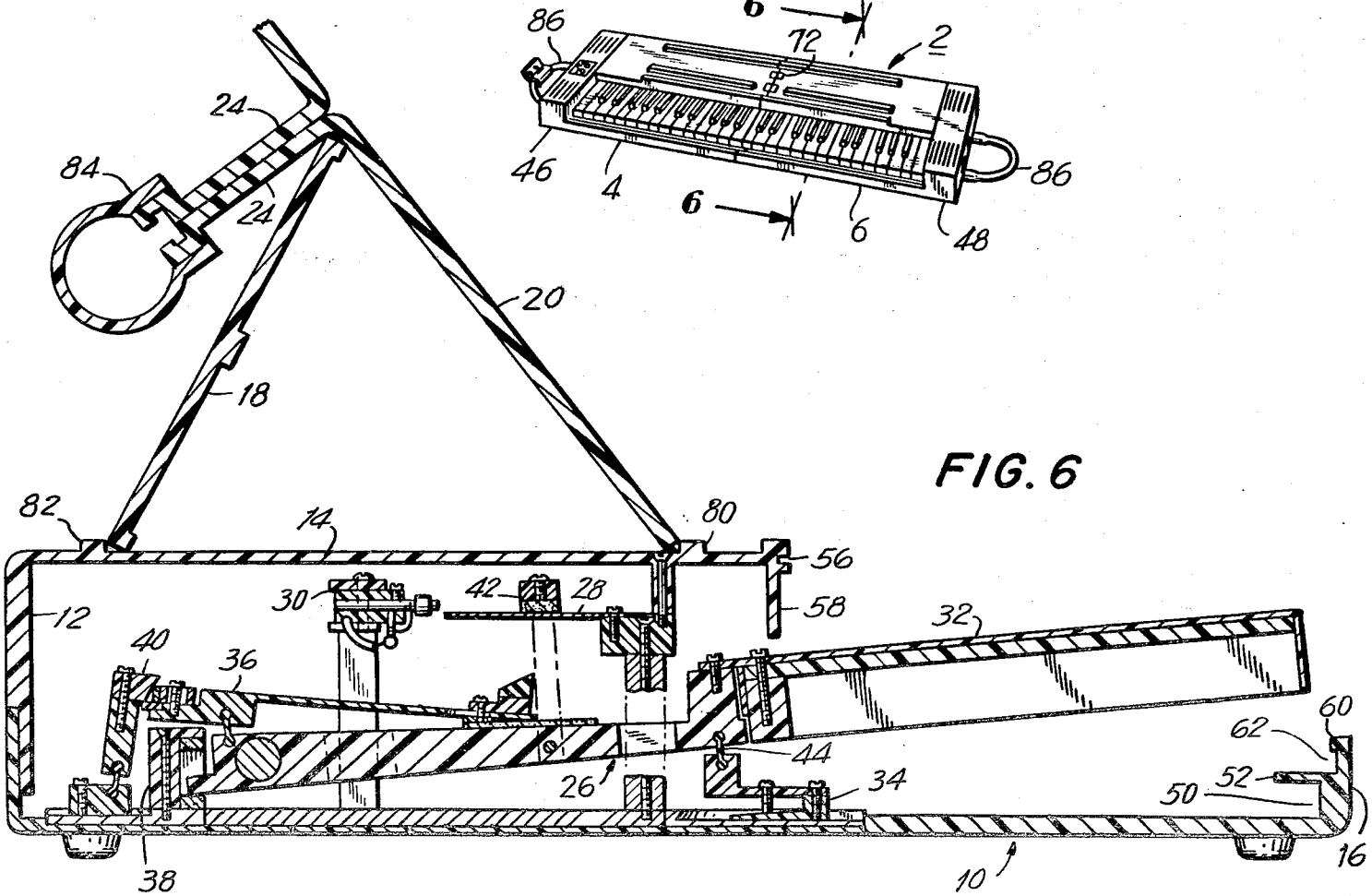
FIG. 5 is a perspective view of the instrument of FIG. 1 in a fully laid open position.
FIG. 6 is a cross-sectional view of the electric keyboard musical instrument of FIG. 5, taken along lines 6—6.

Each assembly half 4 and 6 contains one half the instrumental portion of the instrument 2. As shown in FIG. 6 in particular, and as more fully described in my copending application, there is an interaction between a plurality of actions 26, reeds 28 and pickup assemblies 30 to produce the desire tonal effect. Each action is comprised of a key 32, a key balance mounting assembly 34, a hammer assembly 36, a guide block 38, and an escapement 40 and a damper 42. Advantageously, the key balance mounting assembly contains a flexible hinge 44 which connects the key to the mounting assembly. As more fully described in my copending application, the keys 32 are kept in alignment with respect to each other by means of the key balance mounting assembly and the guide block 38, both of which are mounted on the base 10.

As shown in FIG. 5, a compartment 46 is provided in assembly half 4 for the amplifier and controls and speakers of the instrument. A second compartment 48 is provided in assembly half 6 and it contains the power supply as well as speakers. The wiring between the compartments as well as from the pickup assemblies is advantageously contained in a conduit formed at the juncture of the base 10 and the longitudinal flange 16 by means of a flange member 52. In order to permit the assembly halves to be folded as shown in FIG. 2, a notch portion 54 is provided for the connecting wiring.

When the user of the instrument 2 desires to unfold it from its folded configuration as shown in FIG. 1 to its play configuration of FIG. 5, the end panel 18 is first removed and then the side panels 20 are widthdrawn as indicated by the phantom lines of FIG. 1.

After the user is finished using the keyboard it is readily returned to the folded configuration. First, the assembly halves are folded along the hinge 8 so that the base members 10 are back to back. For convenience the instrument may be placed on a flat surface so that the longitudinal walls 12 contact the surface. Next the side panels 20 are slid into place to protect the keys 32.

In order to hold the panels 20 in place a groove 56 is provided in the end portion of the top wall 14. Adjacent the groove 56 and depending from the wall 14 is a support flange 58. The flange 58 serves to stiffen and strengthen the wall 14 beneath the groove 56. The front portion 24 of panel 20 is also connected to the longitudinal flange 16 by means of a groove 62 formed by a shoulder 60 on flange 16 with the conduit forming flange 52 through which a shoulder 66 on portion 24 slides. In the same manner the end portion 64 of top 22 slides through groove 56, thus securing the side panels 20 firmly and positively in place.

Figure 4:
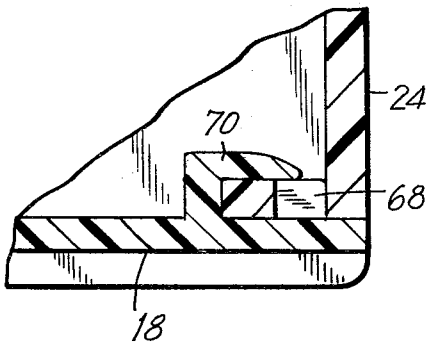
FIG. 4 is a cross-sectional view of the housing assembly of FIG. 2 taken along lines 4—4.

As shown in FIGS. 2 and 4 in particular, the end panel 18 is connected to the side panels 20 by means of ledge members 68 which are provided on the fronts 24 and with which "L" shaped hook brackets 70 interconnect.

Figure 3:
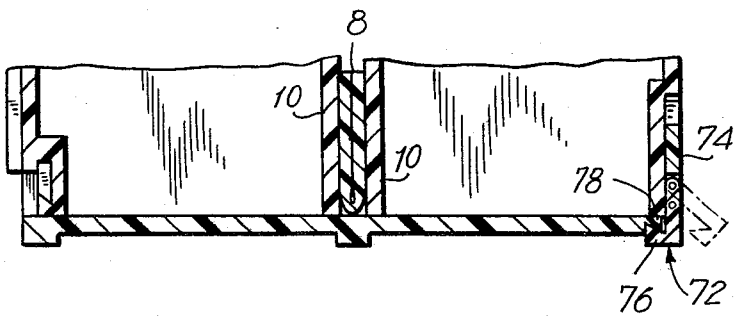
FIG. 3 is a cross-sectional view of the housing assembly of FIG. 2 taken along lines 3—3.

The panel 18 and the side panels 20 are locked in place by latches 72 on the top wall 14 which are offset with respect to each other when the instrument is in its folded configuration as shown in FIG. 2. As shown in FIG. 3, one embodiment of a suitable latch that may be advantageously utilized with the present invention includes a lever 74 which is pivotally connected to wall 14 by a pin and a hook member 76 which is attached to the lever by a second pin. Grooves in the end panel 18 form shoulders 78 with which the hook members 76 of the latch 72 engage, securing the panel to the top walls 14. As a result the outer surface of the folded instrument form an interconnected protective casing for the instrumental components within the casing.

In keeping with the compact concept of the present invention a pair of ribs 80 and 82 are provided which serve as stops for a music stand which may be made by placing the front portions 24 of the side panels 20 in back to back relationship and holding them together by any suitable means such as the clamp 84 as shown in FIG. 6. The edge of one of the panels 20, of the easel thus formed, is positioned against rib 80 and the end panel 18 against the rear rib 82 with the end panel 18 supporting the panels 20.

To those skilled in the art embodiments of the present invention other than the one illustrated in the drawings and described herein will be obvious while still being within the scope of the following claims.

What is claimed is:

1. In an electric keyboard musical instrument having a plurality of actions including keys, reeds and pickup means in spaced relation to said reeds for generating an electric oscillation signal from the vibrations of said reeds and control components therefor, a hand protable protective and securing assembly, comprising:

a protective and supporting assembly including two housing members being hingably connected to each other, whereby said members are adapted to be positioned in a longitudinally aligned configuration and a folded adjacent configuration, each member having an open portion along a first longitudinal section thereof through which said keys extend, said open portions being adapted to be in longitudinally aligned configuration; and removable panel members adapted to overlie the keys and interconnect with said members to form a protective casing for said keys when the members are in a folded configuration, said housing members have bottom, back and top walls which enclose the actions, reeds and pick-up means except along the open portion, and said panel members and said housing members interconnect with an end member to complete the casing when the housing members are in a folded configuration.

2. In an electric keyboard musical instrument as defined in claim 1, wherein the end member and the panel members have interlocking engagement means to connect them together and the end member and at least one of the housing members has second interlocking engagement means to connect them together whereby a complete protective casing for the actions, reeds and pick-up means is provided.

3. In an electric keyboard musical instrument as defined in claim 2 wherein the second interlocking engagement means includes hook devices.

4. In an electric keyboard musical instrument as defined in claim 1, and further including support means for the actions for fixedly connecting the actions to the housing members whereby the keys are kept in alignment with respect to each other when the housing members are in a folded configuration.

5. In an electric keyboard musical instrument as defined in claim 4 wherein the support means includes a key balance mounting assembly connected to the keys and a guide block which limits the rotation of the keys about the key balance assembly.

6. In an electrical keyboard musical instrument as defined in claim 1 and further including conduit means in said housing members for interconnecting the pick-up means.

7. In an electrical keyboard instrument as defined in claim 1 and further including substantially closed compartments in each housing member for housing the control components.

* * * * *